US006416454B1

(12) United States Patent
Kessler et al.

(10) Patent No.: US 6,416,454 B1
(45) Date of Patent: Jul. 9, 2002

(54) CONTROL OF SEPARATION PERFORMANCE IN A CENTRIFUGE BY CONTROLLING A TEMPERATURE DIFFERENTIAL THEREIN

(75) Inventors: Stephen B. Kessler, Princeton; Ascher H. Shapiro, Boston; William M. Cox, Upton, all of MA (US)

(73) Assignee: Kendro Laboratory Products, Inc., Asheville, NC (US)

( * ) Notice: Subject to any disclaimer, the term of this patent is extended or adjusted under 35 U.S.C. 154(b) by 0 days.

(21) Appl. No.: 09/687,032

(22) Filed: Oct. 12, 2000

Related U.S. Application Data

(60) Provisional application No. 60/158,953, filed on Oct. 12, 1999.

(51) Int. Cl.[7] ..... B04B 15/02

(52) U.S. Cl. ..... 494/13; 494/14; 494/37

(58) Field of Search ..... 494/1, 13, 14, 494/37, 58, 62, 65; 210/175, 179

(56) References Cited

U.S. PATENT DOCUMENTS 2,167,881 A * 8/1939 Eberts et al.
2,921,969 A * 1/1960 Loy
3,559,879 A * 2/1971 Bechard
3,981,437 A * 9/1976 Hemfort et al.
4,030,897 A * 6/1977 Pelzer et al.
5,328,441 A * 7/1994 Carr
5,356,367 A * 10/1994 Carr
5,425,698 A * 6/1995 Carr
5,460,717 A * 10/1995 Grimwood et al.
5,674,174 A * 10/1997 Carr
5,733,238 A * 3/1998 Carr
5,743,840 A * 4/1998 Carr
5,823,937 A * 10/1998 Carr

FOREIGN PATENT DOCUMENTS

DE 4315074 * 11/1994
GB 707739 * 4/1954

OTHER PUBLICATIONS

Ambler, C. *Centrifuges*. pp. 19–95—19–101. "Perry's Chemical Engineers' Handbook," Perry, R.H. and Green, D.W. eds. 6th Edition, McGraw–Hill, New York (1984).
Leung, W., *Industrial Centrifugration Technology*. McGraw–Hill, New York (1984).

* cited by examiner

*Primary Examiner*—Charles E. Cooley
(74) *Attorney, Agent, or Firm*—Baker & Hostetler, L.L.P.

(57) ABSTRACT

Separation performance in sedimenting centrifuges, particularly generally cylindrical sedimenting centrifuges, and most particularly imperforate basket centrifuges, is controlled and enhanced by identifying a level of mixing that will produce improved separation performance and then varying the bowl-to-feed temperature differential and/or the centrifuge design to produce a desired level and type of mixing while reducing the tendency toward undesirable type of flow.

18 Claims, 5 Drawing Sheets

CONTROL OF SEPARATION PERFORMANCE IN A CENTRIFUGE BY CONTROLLING A TEMPERATURE DIFFERENTIAL THEREIN

This application claims priority from Provisional application Ser. No. 60/158,953, filed Oct. 12, 1999.

BACKGROUND OF THE INVENTION

The present invention relates to a method of modifying the flow within continuous flow sedimentation centrifuges, particularly "imperforate basket" or "solid bowl" centrifuges, and thereby improving the separation performance thereof. Modification of the centrifuge or its operating conditions can produce an appropriate degree and type of mixing to cause improved separation performance.

Continuous flow sedimentation centrifuges are often assumed to operate in plug flow in modeling their separation performance. The assumption of plug flow was made in developing the widely-used sigma model [Ambler, C., Centrifuges, pp. 19–89–19-101"), in Perry's Chemical Engineers' Handbook, Perry, R. H. and Green, D. W. eds., Sixth Edition, McGraw-Hill, New York (1984)]. Sedimentation centrifuges of widely differing geometries are expected to deviate from the ideal plug flow assumption in their behavior.

For the case of imperforate basket centrifuges, a boundary-layer flow model has been accepted in the literature as the more appropriate model. For example, Leung, in his 1998 book, "Industrial Centrifugation Technology" teaches that it has been known that a very thin boundary layer exists at the pool surface. The layer thickness is very small, typically on the order of millimeters, and is moving at a very high velocity. Injecting a small droplet of dye onto the surface of a rotating pool shows that the dye immediately shears off and spreads out into a thin film, moving at a much higher velocity as compared to that of an assumed plug flow across the annular pool. The incoming stream enters this boundary layer at one end and the effluent stream (centrate) exits the boundary layer at the other end. Below this boundary layer is a "stagnant pool" as observed in the reference frame of the rotating bowl. As the particles from the fast-moving boundary layer settle out into the stagnant pool, essentially the particles settle unimpeded to the bowl wall. As the particles settle from the boundary layer at the pool surface to the stagnant zone, an equivalent volume of clarified liquid is displaced. [Leung, W., Industrial Centrifugation Technology, McGraw-Hill, New York (1998)]

In imperforate basket centrifuges which operate at very high g-forces, the bulk of the liquid in the centrifuge bowl is designed to rotate as a solid body or stagnant pool while an incoming feed skims over the inner radius of the pool. [Leung, W., supra] This assumption of boundary layer flow leads to predictions of separation performance which differ markedly from those predicted by plug flow models.

While substantially boundary layer flow can be induced in an imperforate basket centrifuge by first placing a higher density solution in the bowl of the centrifuge prior to entry of a lower density tracer solution to the top surface of the pool (so the tracer solution skims across the surface of the pool), this is not what has been observed in most real world situations. Similarly, substantial plug flow can also be induced for unusual compositions. But neither boundary layer flow nor plug flow have been found to be fully accurate in predicting the real-world performance of imperforate basket centrifuges with most systems.

To develop improved imperforate basket centrifuges it has been discovered that there is a need to control the degree of mixing and thereby the flow that occurs during operation of such high g-force systems. The present invention utilizes that flow control to enhance the performance of separations performed with the equipment. For products of very high value, seemingly inconsequential product losses can add up to large amounts of revenue over time. Thus there is an immediate payback for the time and attention invested to applying the method of this invention during process development.

It must be noted that experts in the field of centrifuges generally believe that while feed solids concentration is critical to the operation of centrifuges having a cylindrical bowl geometry, e.g. imperforate basket centrifuges, the influence of temperature might be not that interesting because of the high g-forces. While there has been recognition that temperature could be an interesting parameter in low g-force systems, such would not be expected at the high g-force centrifugal accelerations found in the present invention because of high Peclet-Number conditions where the effect of diffusion was thought minimal.

Furthermore, the variations in separation performance that have been observed with the use of centrifuges were considered to be inherent in this type of separation process.

Accordingly, it is an object of this invention to provide means for controlling the extent of mixing which occurs within a sedimentation centrifuge, particularly an imperforate basket centrifuge, to improve the separation performance of the centrifuge.

Most particularly, it is an object of this invention to provide means for controlling the operation of sedimenting centrifuges, particularly those devices utilizing a generally cylindrical bowl geometry.

The foregoing and other objects, advantages and features of the invention will be apparent from the following detailed description of the invention.

SUMMARY OF INVENTION

The present invention is directed to a method of controlling the performance of a centrifuge having a generally cylindrical geometry. More particularly this invention is directed to a method of controlling an imperforate basket centrifuge having an imperforate rotating bowl with an inlet for feed materials and an outlet for centrate and solids, a stationary housing for rotatably mounting the bowl and having a jacket surrounding the bowl, the jacket including means for heating and cooling the bowl. The method comprises changing the temperature in the bowl to obtain a predetermined amount of mixing which will permit optimumization of the operation of the centrifuge for each particular separation.

The invention is further directed to a method of controlling the performance of an imperforate basket centrifuge (as well as similar sedimentation centrifuges with cylindrical bowl geometry) having an imperforate rotating bowl with an inlet for feed materials and an outlet for centrate and solids, a stationary housing for rotatably mounting the bowl and having a jacket surrounding the bowl, the jacket including means for heating and cooling the bowl, by adjusting the temperature in the bowl to encourage or discourage boundary layer flow as needed to enhance separation performance for a particular separation.

The present invention is further directed to a method of controlling the performance of an imperforate basket centrifuge having an imperforate rotating bowl with an inlet for feed materials and an outlet for centrate and solids, a stationary housing for rotatably mounting the bowl and having a jacket surrounding the bowl, the jacket including means for heating and cooling the bowl, by modifying the degree of mixing within the bowl by the addition of mechanical means to the bowl.

The present invention is further directed to a method of improving the performance of an imperforate basket and other similar centrifuges having an imperforate rotating bowl with an inlet for feed materials and an outlet for centrate and solids, a stationary housing for rotatably mounting the bowl and having a jacket surrounding the bowl, the jacket including means for heating and cooling the bowl, by adjusting the temperature in the jacket by an amount sufficient to increase or decrease mixing within the bowl.

The invention is further directed to a method of improving the performance of an imperforate basket centrifuge having an imperforate rotating bowl with an inlet for feed materials and an outlet for centrate and solids, a stationary housing for rotatably mounting the bowl and having a jacket surrounding the bowl, the jacket including means for heating and cooling the bowl, by adjusting the temperature in the jacket by an amount sufficient to discourage boundary layer flow.

The present invention is further directed to a method of improving the performance of an imperforate basket centrifuge having an imperforate rotating bowl with an inlet for feed materials and an outlet for centrate and solids, a stationary housing for rotatably mounting the bowl and having a jacket surrounding the bowl, the jacket including means for heating and cooling the bowl, by increasing mixing within the bowl by the addition of mechanical means to the bowl.

DESCRIPTION OF THE INVENTION

The present invention relates to methods of improving the separation performance of sedimentation centrifuges. More particularly, it is directed to methods of improving the performance of such centrifuges. Sedimentation centrifuges often utilize a generally cylindrical bowl geometry. Still more particularly, it is directed to methods of improving the performance of imperforate basket centrifuges. Such devices may also be known as "solid bowl" centrifuges. Examples of such devices include, but are not limited to, the centrifuges described in U.S. Pat. Nos. 5,328,441, 5,356,367, 5,425,698, 5,674,174, 5,733,238, 5,743,840, 5,823,937, and others.

In general, such devices which separate a feed material into a centrate and solids comprise an imperforate rotating bowl having an inlet for feed materials and an outlet for centrate and solids, a stationary housing for rotatably mounting the bowl and having a jacket surrounding the bowl, the jacket including means for heating and cooling the bowl.

Figure 4:
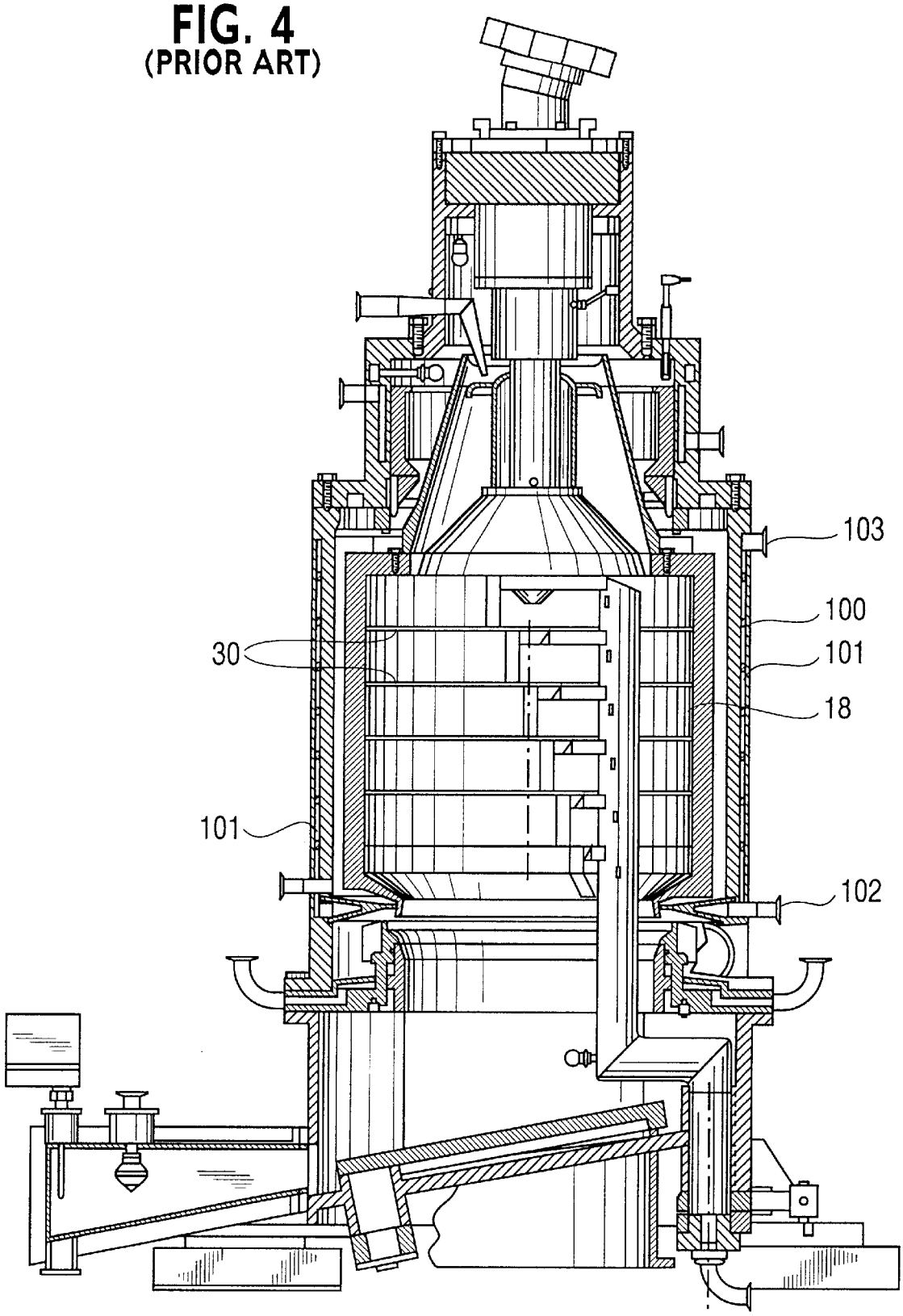
FIG. 4 (PRIOR ART)
FIG. 4 is a partial sectional side view of a prior art centrifuged separator.

FIG. 4, which is taken in substantial part from U.S. Pat. No. 5,733,238, shows a sectional side view of a centrifuge separator as is known in the art. The centrifuge separator includes a jacket 104, within which a bowl 18 rotates. Bowl 18 includes baffles 30. Jacket 104 includes an outer wall 100, an annular passage 101, and an inner wall 105. A heat transfer fluid can be circulated through annular passage 101 as a means of controlling temperature. In use, the heat transfer fluid, which may be either hotter or cooler than bowl 18, is introduced through a port 102, circulates throughout annular passage 101, and exits from a port 103. To maintain a desired temperature differential between bowl 18 and the contents of the bowl (not shown), heat is transferred between the annular passage 101, inner wall 105, a gas space between inner wall 105, and bowl 18. Depending on the temperature differential between bowl 18 and the contents, heat may flow either inwardly or outwardly and bowl 18 may be maintained either hotter or cooler than the contents.

In operation in accordance with the present invention, the temperature in the bowl and its surrounding jacket are controlled relative to one another to obtain a desired amount of mixing which will permit optimumization of the operation of the centrifuge.

Generally the centrifuges of the present invention operate at as high a rotational speed (and thus g-force) as possible, within the safety constraints of the materials and systems. Commonly these devices are operated at g-forces ranging from as low as about 100 to as high as 20,000 ×g (times the force of gravity). More commonly, the g-force is in the range of about 500 to 15,000 ×g.

The centrifuges may be operated at most any temperature, depending upon the nature of the system being processed. Thus suitable process temperatures commonly range from about −40 to about 150° C.

While the present invention is described herein specifically as related to an imperforate bowl centrifuge, the principles are also applicable to other centrifuges, such as those of the tubular bowl type, decanter, chamber bowl, as well as other devices utilizing a generally cylindrical bowl geometry.

Flow in an actual imperforate basket centrifuge was characterized by using tracer methods to measure residence time distribution (RTD). Unexpectedly it was found that, under most conditions, neither plug flow nor boundary-layer flow resulted. Instead the contents of the bowl tended to be well-mixed, more akin to what would be found in a continuous stirred tank reactor.

Figure 1:
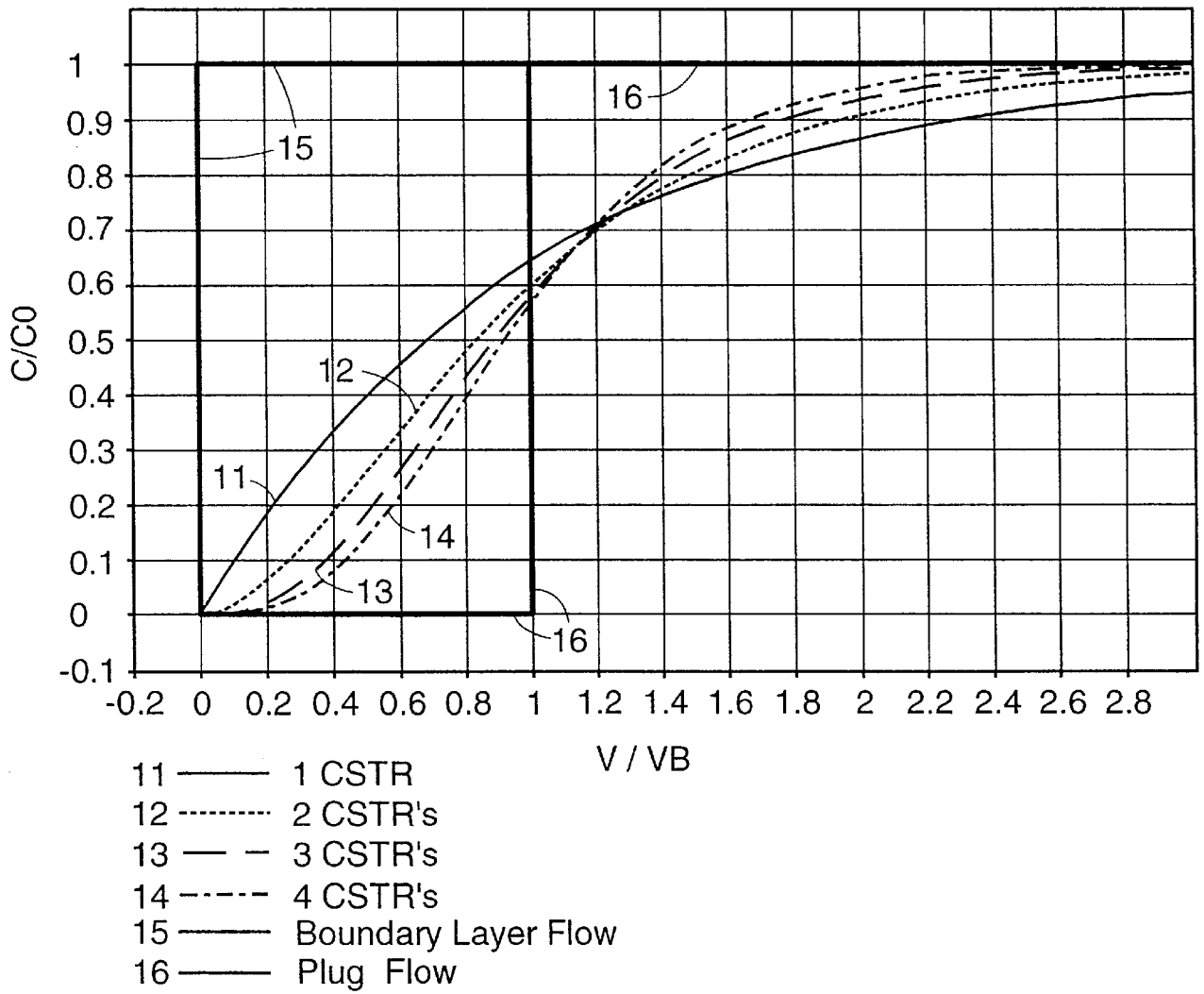
FIG. 1 is a theoretical residence time distribution graph of $C/C_O$ [the concentration of a tracer detected in a centrate divided by the concentration of that same tracer in the feed composition] vs. $V/V_B$ [the volume of liquid fed divided by the pool volume of a centrifuge] showing the expected residence time distribution that would be predicted for a single continuous stirred tank reactor, for multiple continuous stirred tank reactors connected in series, for ideal boundary layer flow, and for ideal plug flow.

FIG. 1 depicts theoretical Residence Time Distribution (RTD) curves that are indicative of different types of flow for nonseparating, tracer-containing systems. In FIG. 1, solid curve 11 is the RTD graph of what would be expected from the mixing which would occur in a single continuous stirred tank reactor (CSTR) The various dotted and dashed curves 12, 13 and 14 reflect the graphs that would be expected from multiple (2, 3, and 4) CSTR's in series. Curve 15 immediately rises from the origin and illustrates the residence time distribution curve for ideal boundary-layer flow, i.e. it is initially vertical as the concentration C of a non-separable tracer in the centrate instantaneously becomes the same as the concentration in the feed composition $C_o$. Curve 16 reflects ideal plug flow, i.e. it is horizontal until the bowl is totally filled and then constant uniform flow occurs. $C/C_o$ is the concentration of a tracer detected in the centrate (the effluent from which solids have been removed) divided by the concentration of that tracer in the feed composition. $V/V_B$ is the volume of liquid fed divided by the bowl volume during operation, i.e. the pool volume or operational of the bowl which is less than the actual total bowl volume.

Figure 2:
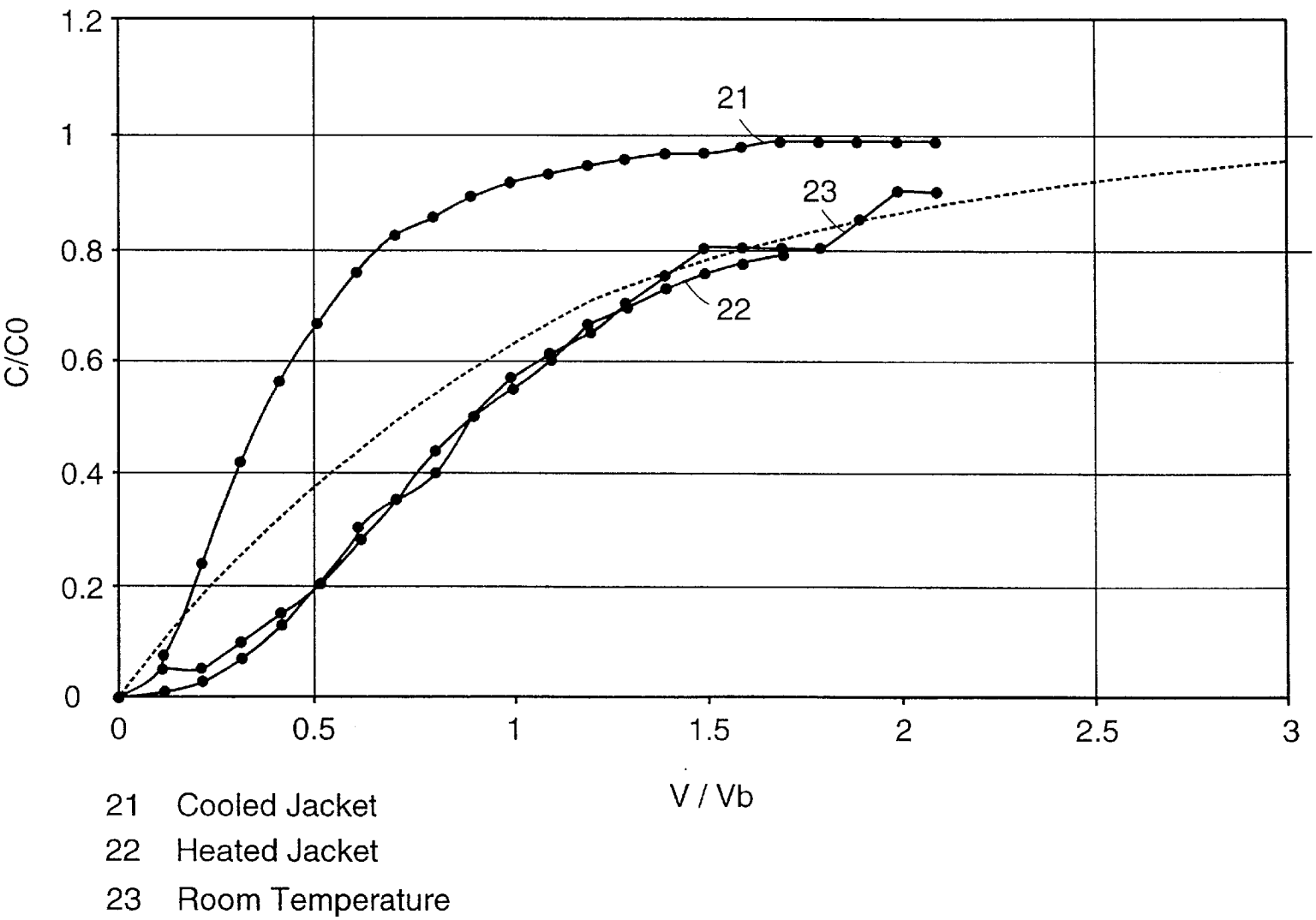
FIG. 2 is an actual residence time distribution graph ($C/C_O$ vs. $V/V_B$) for the presence of a tracer, tryptophan, in water when processed through an imperforate basket centrifuge at various operating conditions.

FIG. 2 shows the results of actual residence time distribution experiments that were performed using a Carr Separations Pilot Powerfuge, operated at 2000 ×g and at a flow rate of 100 milliliters/min. Tryptophan, an amino acid that absorbs in the ultraviolet range, was used as a tracer and a Pharmacia UV detector was used to monitor the tryptophan concentration in the centrate. Curve 21 (the uppermost curve) was produced under "cooled jacket" conditions. The solid curve is the theoretical CSTR curve shown FIG. 1. The lower two curves, 22 and 23, which are almost identical, correspond to "heated jacket" (22) and "room temperature" (23) conditions.

In the three experiments depicted in FIG. 2, the only condition that was changed was the temperature distribution between the jacket and the feed. Under "cooled jacket" conditions (curve 21), the wall of the bowl was approximately 40° C. cooler than the feed at the start of the run. Under "room temperature" conditions (curve 22), the bowl and feed both started at room temperature and although no heating or cooling was applied the bowl became approximately 2° C. warmer than the feed over the course of the run. Under "heated jacket" conditions (curve 23), the wall of the bowl was maintained approximately 40° C. warmer than the feed.

Analysis of FIGS. 1 and 2 shows that the different temperature conditions correlate with markedly different types of flow. The "cooled jacket" condition of FIG. 2 correlates with a flow which tends somewhat toward boundary layer flow, i.e. it is initially more vertical. Both the "heated jacket" and "room temperature" conditions produced a flow that is close to that which would be produced by a continuous stirred tank reactor. The similarity in results between "heated jacket" operation (in which the bowl was substantially hotter than the feed due to the 40° C. temperature difference) and "room temperature" operation (in which the bowl temperature is about 2° C. warmer than the feed) indicates that the magnitude of the temperature differential is less important than the direction thereof. Thus, suitable temperature differentials for purposes of the present invention are in the range of about 5 to 50° C.

Figure 3:
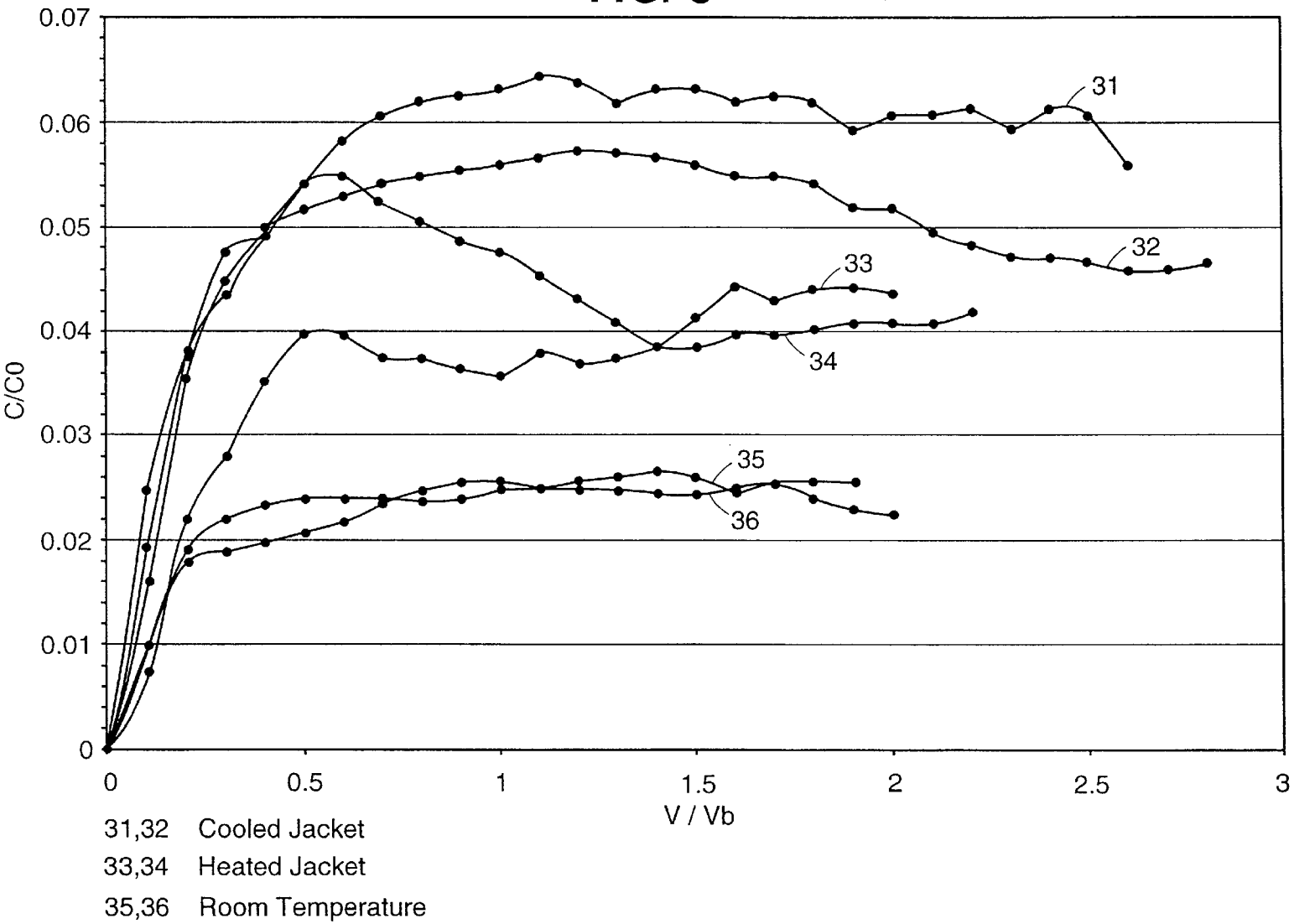
FIG. 3 is an actual separation performance graph ($C/C_O$ vs. $V/V_B$) for the separation of yeast cells from an aqueous dispersion thereof by means of an imperforate basket centrifuge at various operating conditions.

Actual separations were performed under the same 3 sets of conditions as in FIG. 2 to measure the effect of the different types of flow on separation performance. FIG. 3 shows the results of the experiments.

An aqueous dispersion of yeast cells was fed to the Pilot Powerfuge used in FIG. 2 and the concentration of yeast cells in the centrate was monitored by an Optek photometer. Each experiment was performed in duplicate.

When a centrifuge is used for separating, it is not the overall shape of the curve that is important. Rather it is the level at which each curve plateaus because the lower the plateau the greater the degree of separation that has occurred.

The uppermost curves 31 and 32 in FIG. 3 are the result of the "cooled jacket" runs, the intermediate set of curves 33 and 34 resulted from the "heated jacket," and the lowermost set of curves 35 and 36 resulted from the "room temperature" runs.

Surprisingly, the "cooled jacket" condition which best correlated with boundary-layer flow in FIG. 2 gave the poorest separation performance. The "heated jacket" condition resulted in an intermediate level of performance and the "room temperature" condition gave the best performance for this specific separation.

Figure 5:
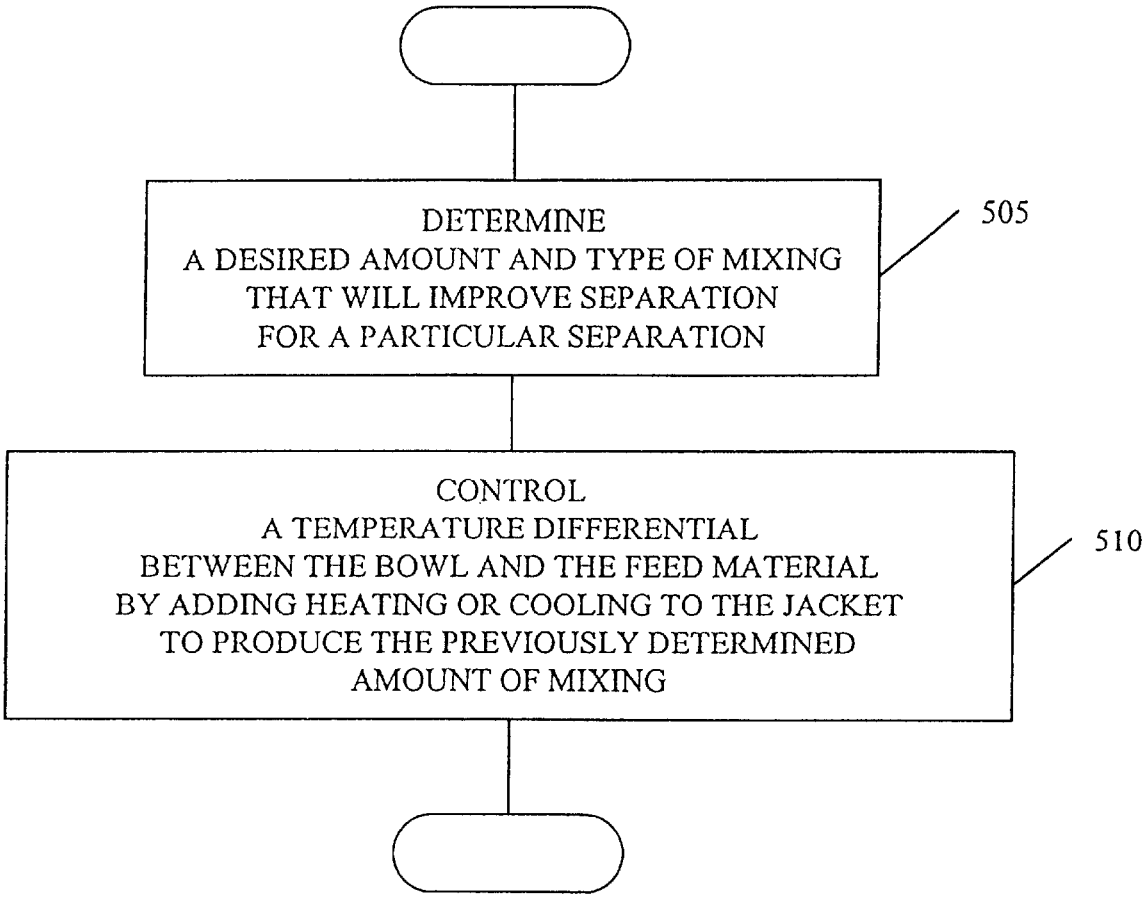
FIG. 5 is a flowchart of a method for control of separation performance in a centrifuge in accordance with the present invention.

FIG. 5 is a flowchart of a method for control of separation performance in a centrifuge having a rotating bowl with an inlet for feed material, and a jacket for heating and cooling the bowl, The method begins with step 505, In step 505, determine a desired amount and type of mixing that will improve separation for a particular separation. The method then advances to step 510. In step 510, control a temperature differential between the bowl and the feed material by adding heating or cooling to the jacket to produce the previously determined amount of mixing. Improved separation is obtained, for example, by encouraging or discouraging boundary layer flow.

There are yet other types of centrifugal separations wherein the "cooled jacket" condition and accompanying boundary layer flow have provided improved separation performance, e.g. the separation of shear-sensitive cells from mammalian or insect cell culture or blood. Such cells commonly exhibit a small density difference from the suspending media, they are easily deformable, and due to their shear-sensitivity, centrifugal separations are carried out at relatively lower g-force where there is a tendency for such cells to remain suspended as a liquid concentrate in the centrifuge bowl, instead of forming a solid cake as happens with yeast cells and most other solid particles.

It has been found that in separating cells that tend to remain suspended in the centrifuge bowl, the type of mixing exhibited in the "heated jacket" and "room temperature" conditions is generally detrimental. While the increased mixing may initially enhance separation performance, the usable capacity of the bowl is greatly reduced because the separated cells continue to circulate in the bowl, leading to "premature break-through," i.e. the concentration of cells in the centrate increases to unacceptably high levels after feeding a relatively small quantity of cell suspension. Under "cooled jacket" conditions the usable capacity of the bowl is increased significantly, thereby increasing the overall separation efficiency.

When repeating a test cell separation using a standard commercial centrifuge which had previously worked, the desired separation would not occur. It was then recognized that the air conditioning was not working in the building. Thus the temperature of the bowl was slightly higher than that of the feed. The centrifuge jacket was then hooked up to a chiller and the separation began working. This observation confirms that the magnitude of the temperature differential between bowl and feed is less important than the direction thereof. Thus, suitable temperature differentials may range from about 5 to 50° C.

Accordingly, controlling the bowl-to-feed temperature during operation of a high g-force imperforate basket centrifuge allows control of the degree of mixing that occurs within the centrifuge and identification of conditions which will result in an improved degree of separation.

The observed results indicate is that there is an optimum level of mixing that will produce the best separation performance for a given separation. Application of the method described provides a means, previously unknown in the field, of optimizing centrifugal separation processes. Previously when determining optimum process conditions, the temperature differential between the bowl and the feed was not considered. In developing and running commercial processes, neither the magnitude nor the sign of the temperature difference was kept constant from run to run.

By considering and controlling the bowl-to-feed temperature difference during process development, a centrifugal separation process can be further optimized, giving improved and more consistent performance in use.

In those situations where temperature control in a system is dictated by other, overriding factors, then the degree of mixing may be modified by the addition of mechanical means to the bowl. For example, if the bowl must be kept colder than the feed to avoid product denaturation, then the flow will inherently tend to be of the boundary-layer type with little to no mixing occurring. In this case, separation performance and uniformity may be improved by intentionally causing some mixing by adding features such as baffles or nibs to the bowl. The number size and placement of the baffles or nibs for optimum performance can be determined for each separation by routine experimentation.

Similarly, for those products for which there is some economic advantages in not cooling the bowl and allowing its temperature to exceed that of the feed, then modification of the feed mechanism to introduce the feed below the surface of the bowl can be used to reduce mixing and/or incorporating a baffle of the sort that will suppresses mixing can be used to control flow and thereby enhance separation.

What is claimed is:

1. A method of controlling the peformance of an imperforate basket centrifuge having an imperforate rotating bowl with an inlet for feed materials and an outlet for centrate and solids, a stationary housing for rotatably mounting the bowl and having a jacket surrounding the bowl, the jacket including means for heating and cooling the bowl, said method comprising (i) determining a desired amount and type of mixing which will improve separation for a particular separation, and (ii) controlling a temperature differential between the bowl and the feed material by adding heating or cooling to the jacket to produce the previously determined amount of mixing.

2. The method of claim 1, wherein the temperature of the bowl is changed to be cooler than that of the feed materials.

3. The method of claim 1, wherein the temperature of the bowl is changed to be warmer than that of the feed materials.

4. The method of claim 1, wherein the temperature differential is changed by about 5 to 50° C.

5. The method of claim 1, wherein the temperature of the bowl is changed from being warmer than that of the feed materials to being cooler than that of the feed materials.

6. The method of claim 1, wherein shear-sensitive cells are separated from mammalian or insect cell culture or blood.

7. The method of claim 6, wherein the temperature of the bowl is cooler than that of the feed material.

8. The method of claim 1, further comprising incorporating one or more baffles within the bowl.

9. The method of claim 1, wherein the centrifuge is operated at a g-force ranging from about 100 to 20,000 times the force of gravity.

10. The method of claim 9, wherein the g-force ranges from about 500 to 15,000 times the force of gravity.

11. A method of controlling the performance of a sedimentation centrifuge with cylindrical bowl geometry having an imperforate rotating bowl with an inlet for feed materials and an outlet for centrate and solids, a stationary housing for rotatably mounting the bowl and having a jacket surrounding the bowl, the jacket including means for heating and cooling the bowl, said method comprising adjusting the temperature differential between the bowl and the feed material to encourage or discourage boundary layer flow as needed to enhance separation performance.

12. The method of claim 11, wherein the temperature of the bowl is changed to be cooler than that of the feed materials.

13. The method of claim 11, wherein the temperature of the bowl is changed to be warmer than that of the feed materials.

14. The method of claim 11, wherein the temperature differetial is changed by about 5 to 50° C.

15. The method of claim 11, wherein the temperature of the bowl is changed from being waxer than that of the feed materials to being cooler than that of the feed materials.

16. The method of claim 11, further comprising incorporating one or more baffles within the bowl.

17. The method of claim 11, wherein the centrifuge is operated at a g-force ranging from about 100 to 20,000 times the force of gravity.

18. The method of claim 17, wherein the g-force ranges from about 500 to 15,000 times the force of gravity.

* * * * *